US010329930B2

(12) United States Patent
Roussille et al.

(10) Patent No.: US 10,329,930 B2
(45) Date of Patent: Jun. 25, 2019

(54) TURBINE RING ASSEMBLY WITH SEALING

(71) Applicants: HERAKLES, Le Haillan (FR); SNECMA, Paris (FR)

(72) Inventors: Clément Roussille, Bordeaux (FR); Gael Evain, Fontenay-Tresigny (FR); Aline Planckeel, Le Haillan (FR); Claire Groleau, Montrouge (FR); Thierry Tesson, Bordeaux (FR)

(73) Assignees: SAFRAN CERAMICS, Le Haillan (FR); SAFRAN AIRCRAFT ENGINES, Paris (FR)

( * ) Notice: Subject to any disclaimer, the term of this patent is extended or adjusted under 35 U.S.C. 154(b) by 407 days.

(21) Appl. No.: 15/087,195

(22) Filed: Mar. 31, 2016

(65) Prior Publication Data

US 2016/0290145 A1 Oct. 6, 2016

(30) Foreign Application Priority Data

Apr. 1, 2015 (FR) ..... 15 52815

(51) Int. Cl.
*F01D 9/04* (2006.01)
*F01D 11/08* (2006.01)
*F01D 25/24* (2006.01)

(52) U.S. Cl.
CPC ..... *F01D 9/04* (2013.01); *F01D 25/246* (2013.01); *F01D 11/08* (2013.01); *F05D 2240/11* (2013.01); *F05D 2300/6033* (2013.01)

(58) Field of Classification Search
CPC ..... F01D 9/04; F01D 25/246; F01D 11/08; F01D 11/12; F01D 11/122; F01D 11/14;
(Continued)

(56) References Cited

U.S. PATENT DOCUMENTS 3,966,356 A * 6/1976 Irwin ..... F01D 11/08 277/545
4,676,715 A * 6/1987 Imbault ..... F01D 25/246 415/116

(Continued)

FOREIGN PATENT DOCUMENTS

DE 826 673 C 1/1952
DE 826673 C * 1/1952 ..... F01D 5/284

(Continued)

OTHER PUBLICATIONS

Search Report as issued in French Patent Application No. 1552815, dated Jan. 29, 2016.

*Primary Examiner* — Igor Kershteyn
*Assistant Examiner* — Topaz L. Elliott
(74) *Attorney, Agent, or Firm* — Pillsbury Winthrop Shaw Pittman LLP

(57) ABSTRACT

A turbine ring assembly includes a ring support structure and a plurality of ring sectors made of CMC material and forming a turbine ring, each ring sector including an annular base with respective end portions having edges that are held facing an edge of the end portion of the annular base of a sector that is adjacent in the turbine ring. The assembly includes resilient holder devices for holding the ring sectors in position on the ring support structure, and each resilient holder device includes a spring element present beside the outside face of the ring support structure.

6 Claims, 4 Drawing Sheets

(58) Field of Classification Search
CPC ..... F01D 11/16; F01D 11/18; F01D 11/24; F05D 2240/11
USPC ..... 415/173.3
See application file for complete search history.

(56) References Cited

U.S. PATENT DOCUMENTS

| | | | | | |
|---|---|---|---|---|---|
| 5,456,576 | A * | 10/1995 | Lyon | F01D 5/20 | 415/173.3 |
| 5,545,007 | A * | 8/1996 | Martin | F01D 11/22 | 415/118 |
| 5,601,402 | A * | 2/1997 | Wakeman | F01D 11/22 | 415/173.1 |
| 9,945,256 | B2 * | 4/2018 | Freeman | F01D 25/246 | |
| 2012/0027572 | A1 | 2/2012 | Denece et al. | | |

FOREIGN PATENT DOCUMENTS

| | | | |
|---|---|---|---|
| EP | 0 192 516 | A1 | 8/1986 |
| WO | WO 2006/136755 | A2 | 12/2006 |

* cited by examiner

TURBINE RING ASSEMBLY WITH SEALING

CROSS-REFERENCE TO RELATED APPLICATIONS

This application claims priority to French Patent Application No. 1552815, filed Apr. 1, 2015, the entire contents of this application is incorporated herein by reference in its entirety.

BACKGROUND OF THE INVENTION

The invention relates to a turbine ring assembly for a turbine engine, which assembly comprises a ring support structure and a plurality of single-piece ring sectors made of ceramic matrix composite material.

The field of application of the invention is in particular that of gas turbine aeroengines. Nevertheless, the invention is applicable to other turbine engines, e.g. industrial gas turbines.

Ceramic matrix composite materials (CMCs) are known for conserving their mechanical properties at high temperatures, thereby making them suitable for constituting hot structural elements.

In gas turbine aeroengines, improving efficiency and reducing certain polluting emissions has led to seeking operation at ever-higher temperatures. When turbine ring assemblies are made entirely out of metal, it is necessary to cool all of the elements of the assembly, and in particular the turbine ring, which is subjected to very hot streams, typically above the temperature that can be withstood by the metal material. Such cooling has a significant impact on the performance of the engine since the cooling stream that is used is taken from the main stream through the engine. In addition, the use of metal for the turbine ring puts a limit on potential increases of temperature in the turbine, even though such increases would nevertheless make it possible to improve the performance of aeroengines.

That is why it has already been envisaged to use CMCs for various hot portions of engines, particularly since CMCs present the additional advantage of density that is lower than that of the refractory metals that have traditionally been used.

Thus, making turbine ring sectors as single pieces of CMC is described in particular in Document US 2012/0027572. Each ring sector comprises an annular base having an inside face that defines the inside face of the turbine ring and an outside face from which there extend two tab-forming portions with ends that are engaged in housings of a metal ring support structure.

The use of CMC ring sectors makes it possible to reduce significantly the ventilation needed for cooling the turbine ring. Nevertheless, holding the ring sectors in position remains a problem, in particular in the face of differential expansion that can occur between the metal support structure and the CMC ring sectors. In addition, another problem lies in the stresses generated by the imposed movements.

OBJECT AND SUMMARY OF THE INVENTION

The invention seeks to avoid such drawbacks, and for this purpose it proposes a turbine ring assembly comprising a ring support structure and a plurality of ring sectors made of ceramic matrix composite material making up a turbine ring, each ring sector comprising an annular base with, in a radial direction of the turbine ring, an inside face defining the inside face of the turbine ring and an outside face facing the inside face of the ring support structure, each said annular base including at each circumferential end a circumferential edge that is held facing a circumferential edge of the circumferential end of the annular base of a ring sector that is adjacent in the turbine ring, the assembly being characterized in that said assembly comprises resilient holder devices, each resilient holder device exerting a force on the circumferential ends of two adjacent ring sectors, holding said adjacent sectors in position, and in that each resilient holder device comprises a spring element present beside the outside face of the ring support structure.

By using resilient holder devices, it is ensured that the ring sectors are held in position in the event of differential expansion between the sectors and the support structure, with such movements being compensated by the resilient holding. In addition, by placing the ring element of each resilient holder device beside the outside face of the ring support structure, the spring element is spaced away from the hot stream flowing in the passage and is exposed only to temperatures that are compatible with the material of the spring. There is therefore no need to cool the spring elements, and it is then possible to use more ordinary materials for fabricating them, such as metal materials.

According to a characteristic of the turbine ring assembly of the invention, it includes a plurality of gaskets, each gasket extending axially over the circumferential ends of two adjacent sectors at the facing edges of said ends. The resilient holder devices exert force that holds the gaskets in contact with the circumferential ends of two adjacent ring sectors.

By placing and holding a gasket over the zone where the axial edges of the sectors face one another in the ring, leaks of the gas stream flowing inside the passage formed by the inside face of the ring sectors are limited. In addition, since the gaskets are held by resilient holder devices, the gaskets are held in position and consequently the passage is sealed.

According to an embodiment of the turbine ring assembly of the invention, the ring support structure has an upstream annular radial flange and a downstream annular radial flange with the ring sectors being held between them without being attached to said flanges, each gasket having an upstream end passing through a slot formed in the upstream radial flange and a downstream end passing through a slot formed in the downstream radial flange. Each ring sector presents a K-shape in a plane defined by the radial direction and the circumferential direction of the turbine ring, with tabs extending from the outside face of the annular base over the circumferential ends of said annular base, circumferential edges of the tabs and the circumferential edges of the circumferential ends of each ring sector being held respectively facing the circumferential edges of tabs and the circumferential edges of ring sectors that are adjacent in the ring. Each resilient holder device exerts a force on the facing tabs of two adjacent ring sectors that is directed radially towards the outside of the turbine ring, holding the corresponding gasket in contact with the circumferential ends of two adjacent ring sectors. Since the ring sectors are not fastened directly to the support structure, the imposed movements are significantly reduced, and consequently the stresses on the ring sectors are significantly reduced. The ring sectors can thus be positioned more easily relative to one another in order to define a more coherent shape for the turbine ring.

In an aspect of the embodiment of the turbine ring assembly of the invention, the gaskets are constituted by strips of ceramic matrix composite material.

In another aspect of the embodiment of the turbine ring assembly of the invention, each resilient holder device comprises a bolt and a spring, the bolt having a head present between the outside face of a gasket and the tabs of two adjacent sectors, the spring being mounted in a prestressed state between a shroud of the ring support structure and a nut fastened to the end of the bolt remote from its end having the head.

In another embodiment of the turbine ring assembly of the invention, the ring support structure includes tabs that extend from the inside face of a shroud, each tab including a folded-over portion. Each ring sector includes tabs extending from the outside face of its annular base, each tab having a folded-over portion engaged with the folded-over portion of a tab of the ring structure. Each resilient holder device exerts a pressing force on each gasket holding the gasket in contact with the circumferential ends of two adjacent ring sectors.

In another aspect of the embodiment of the turbine ring assembly of the invention, each resilient holder device comprises a shoe in contact with the top surface of the gasket, a rod extending vertically from the outside surface of the shoe, and a spring exerting a pressing force on the free end of the rod.

BRIEF DESCRIPTION OF THE DRAWINGS

The invention can be better understood on reading the following description given by way of non-limiting indication and with reference to the accompanying drawings, in which.

DETAILED DESCRIPTION OF EMBODIMENTS

Figure 1:
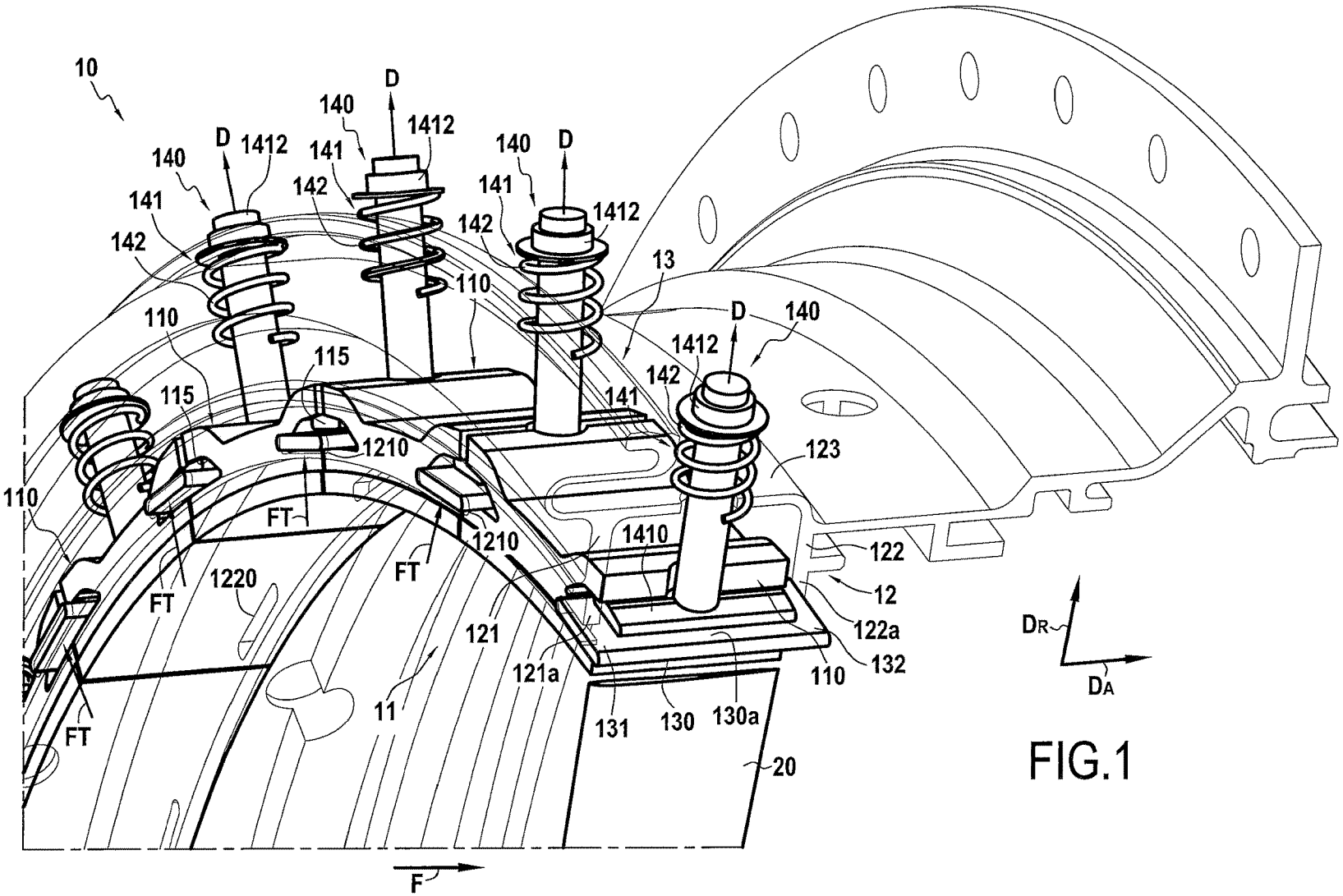
FIGS. 1 and 2 are perspective views showing a portion of a turbine ring assembly in accordance with an embodiment of the invention.
Figure 2:
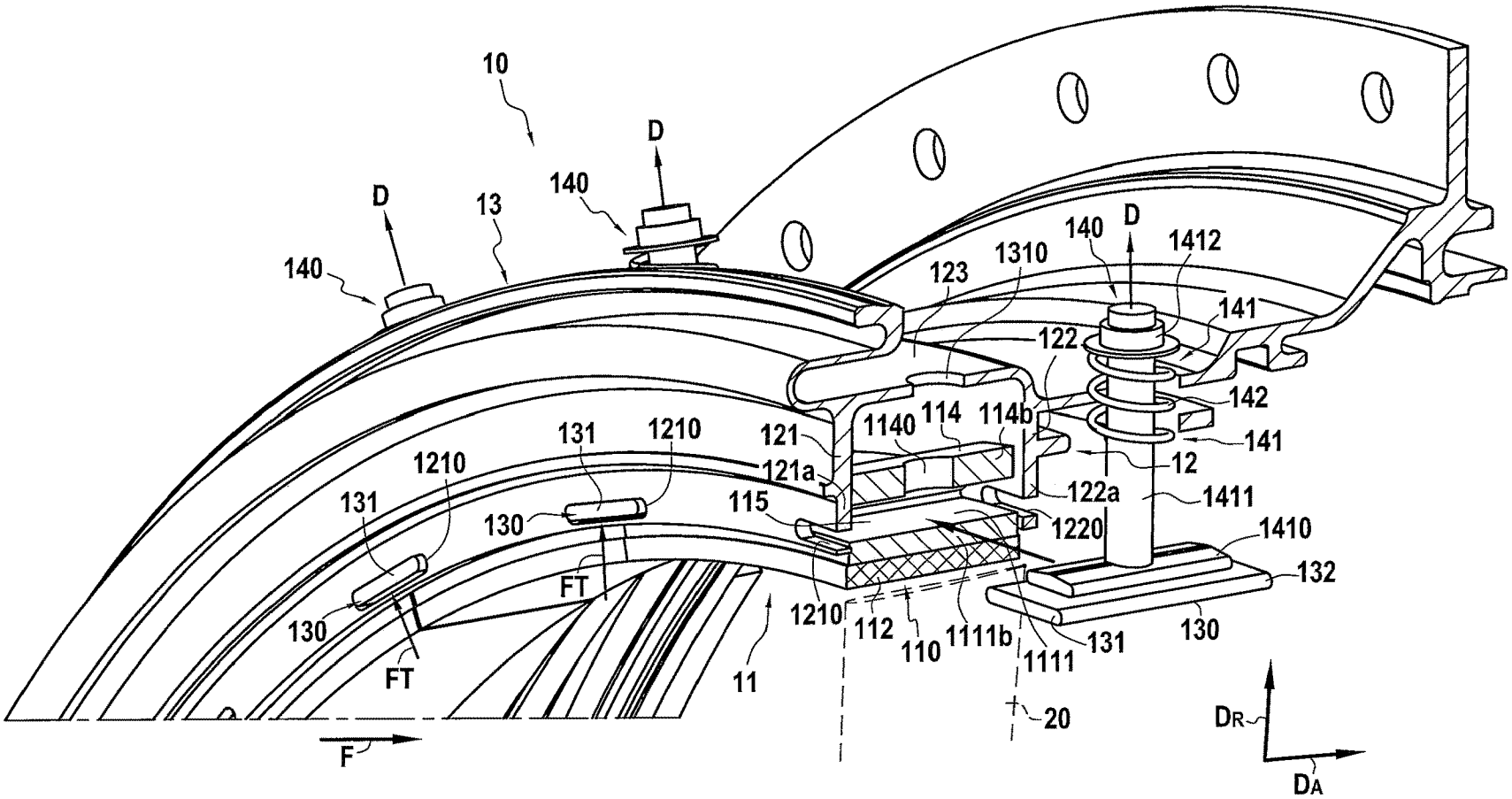

FIGS. 1 and 2 show a high-pressure turbine ring assembly 10 in an embodiment of the invention. The assembly 10 comprises a CMC turbine ring 11 and a metal ring support structure 12. The turbine ring 11 surrounds a set of rotary blades 20. The turbine ring 11 is made up of a plurality of ring sectors 110, with FIGS. 1 and 2 being perspective views showing a portion of the high-pressure turbine ring assembly 10 with an axial section showing the edges of a ring sector 110. Arrow $D_A$ points in the axial direction of the turbine ring 11 and arrow $D_R$ points in the radial direction of the turbine ring 11.

Figure 3:
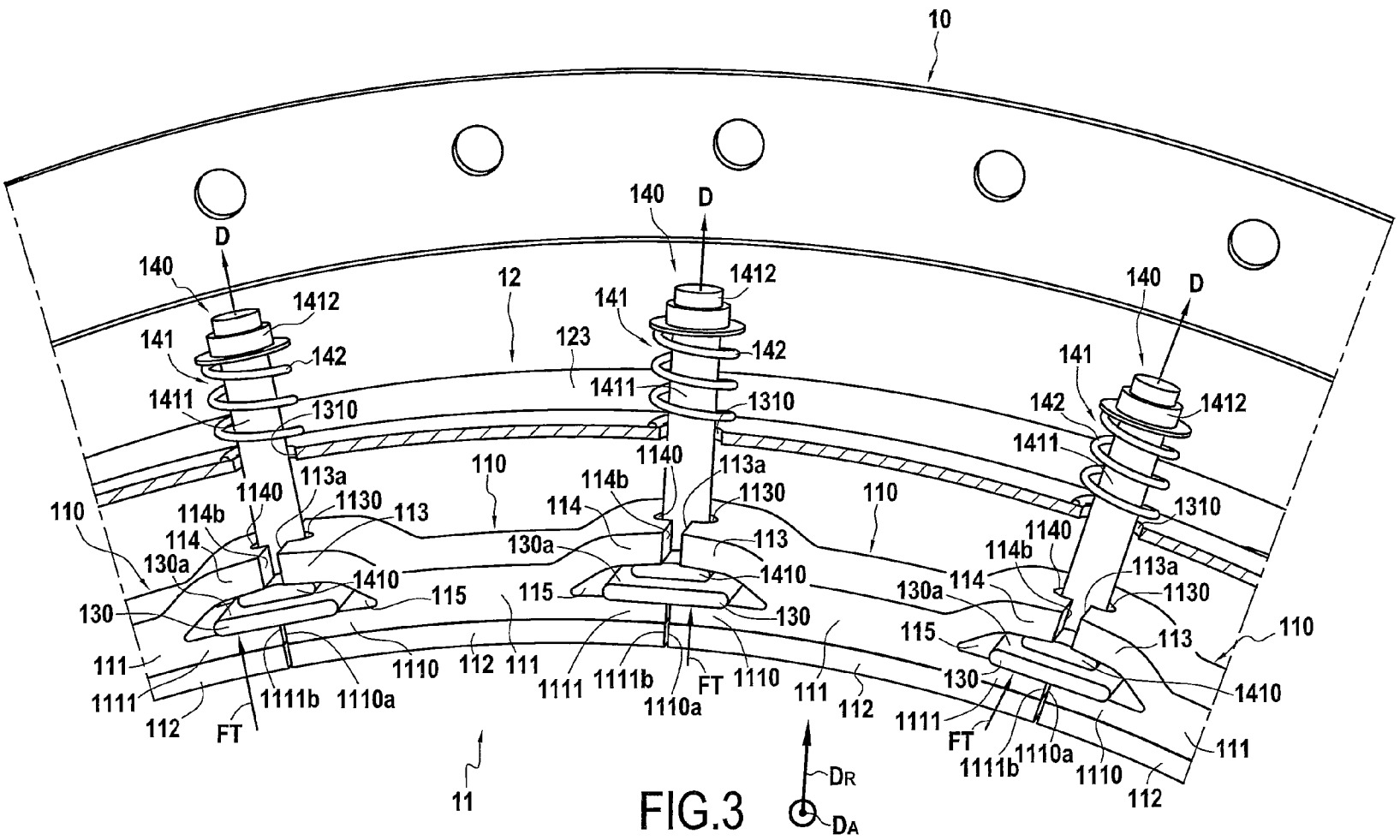
FIG. 3 is a radial section view of the turbine ring assembly of FIGS. 1 and 2.

As shown in FIG. 3, each ring sector 110 is K-shaped in a plane defined by the radial direction $D_R$ and by the circumferential direction of the turbine ring 11, the sector having an annular base 111 with its inside face in the radial direction $D_R$ coated in a layer 112 of abradable material, this inside face defining the flow passage for the gas stream through the turbine. Substantially S-shaped tabs 113, 114 extend from the outside face of the annular base 111 in the radial direction $D_R$, over its entire width, and above circumferential ends 1110 and 1111 of the annular base 111. Each annular sector 110 thus has two circumferential edges 1110*a* & 113*a* and 1111*b* & 114*b* at each of its ends in the circumferential direction of the ring 11. The edges 1110*a* and 113*a* situated on a first end of a sector 110 are for being held facing respective edges 1111*b* and 114*b* of the ring sector that is adjacent in the turbine ring.

The ring support structure 12 is secured to a turbine casing 13. The structure 12 has an upstream annular radial flange 121 and a downstream annular radial flange 122 that extend from a shroud 123 of the turbine casing. The terms "upstream" and "downstream" are used herein with reference to the flow direction of the gas stream through the turbine (arrow F in FIGS. 1 and 2). The flanges 121 and 122 present respective bottom edges 121*a* and 122*a*.

The ring sectors 110 are arranged in annular manner between the flanges 121 and 122 of the metal ring support structure 12, the inside face of the ring having the layer 112 of abradable material extending beyond the bottom edges 121*a* and 122*a* of the flanges 121 and 122.

In order to provide good sealing between the flow passage for the gas stream through the turbine and the outside of the turbine ring, gaskets 130 are placed between adjacent ring sectors at their facing edges. More precisely, the gaskets 130 are dimensioned and placed in such a manner as to cover the end portions 1111 and 1110 of the annular bases 111 of two adjacent ring sectors 110. The gaskets 130 are placed in respective housings 115, each having its bottom formed by the circumferential ends 1111 and 1110 of two adjacent sectors in combination, the top portion of each housing 115 being formed by the tabs 114 and 113 of two adjacent sectors in combination. In this example, the gaskets 130 are made of CMC. The upstream ends 131 and the downstream ends 132 of the gaskets 130 pass through respective slots 1210 and 1220 formed respectively in the upstream and downstream flanges 121 and 122 (FIGS. 1 and 2).

The two adjacent ring sectors 110 and the gasket 130 present between the two adjacent sectors are held by a traction device 140 constituted by a bolt 141 and a spring 142. The bolt 141 has a head 1410 that is placed between the outer face 130*a* of the corresponding gasket 130 and the tabs 114 and 113 of two adjacent sectors. Notches 1140 and 1130 are formed respectively in the tabs 114 and 113 so as to pass the shank 1411 of the bolt 141. Likewise, orifices 1310 are formed in the shroud 123 of the turbine casing 13 so as to pass the shank 1411 of the bolt 141.

The spring 142 is a compression spring mounted in a prestressed state between the shroud 123 and a nut 1412 engaged on the end of the bolt 141 remote from its end having the head 1410. Thus, the spring 142 exerts a force on the nut 1412 that is directed radially towards the outside of the ring 11 in a direction D shown in FIGS. 1 and 3 and transmitted to the head 1410 of the bolt 141 via the shank 1411 of the bolt. The head 1410 then exerts a force that is directed in the direction D on the tabs 113 and 114 of two adjacent sectors 110. This force is also transmitted to the circumferential ends 1110 and 1111 of two adjacent sectors 110 that in turn exert a force FT that is directed radially towards the outside of the ring 11 against the gasket 130 interposed between the circumferential ends 1110 and 1111 of the tabs 113 and 114 of two adjacent sectors 110. Under the effect of this force, the gaskets 130 are held in abutment against the top portions of the slots 1210 and 1220 formed respectively in the flanges 121 and 122. Sealing between adjacent sectors, i.e. sealing between the gas flow passage on the inside of the ring sectors and on the outside of the ring sectors, is thus provided by the gaskets 130. In addition, since both the ring sectors 110 and the gaskets 130 are held in position by resilient means (springs 142), mechanical connection and sealing between the ring sectors is ensured even when movements are imposed by differential thermal expansion.

Since each spring 142 is placed beside the outside face of the ring support structure (outside face of the shroud 123), it is spaced away from the hot stream flowing in the passage and is exposed only to temperatures that are compatible with the material of the spring. There is therefore no need to cool the springs, and it is possible to use materials such as metal materials for fabricating them.

Figure 4:
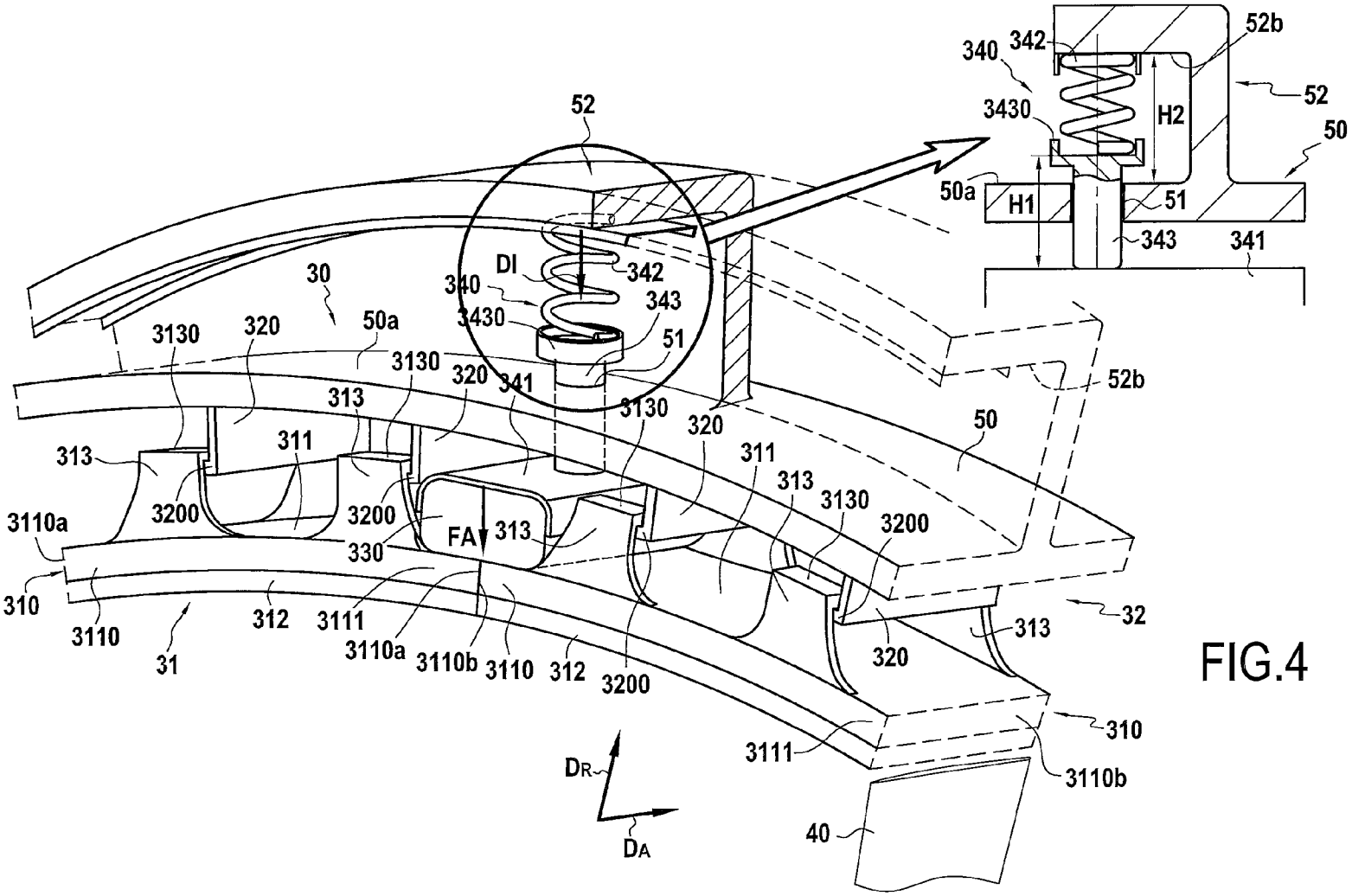
FIG. 4 is a perspective view showing a portion of a turbine ring assembly in accordance with another embodiment of the invention.

FIG. 4 shows a high-pressure turbine ring assembly 30 in accordance with another embodiment of the invention. The assembly 30 comprises a CMC turbine ring 31 and a metal ring support structure 32. The turbine ring 31 surrounds a set of rotary blades 40. The turbine ring 31 is made up of a plurality of ring sectors 310, with FIG. 4 being a perspective view showing a portion of the high-pressure turbine ring assembly 30 with an axial section showing the edge of a ring sector.

As shown in FIG. 4, each ring sector 310 comprises an annular base 311 having its inside face coated in a layer 312 of abradable material defining the flow passage for the gas stream through the turbine. Tabs 313, each having a folded-over portion 3130, extend from the outside face of the annular base 311 at circumferential ends 3110 and 3111 of the annular base 311. In the presently-described example, each sector 310 has four tabs 313 arranged in pairs on each annular edge of the sector, the folded-over portion 3130 of each tab 313 extending axially over the annular base 311. Each annular sector 310 has a first circumferential edge 3110*a* and a second circumferential edge 3110*b*. The edge 3110*a* situated at a first end of a sector 310 is for being held facing the edge 3110*b* of the ring sector that is adjacent in the turbine ring.

The ring support structure 32 is secured to a turbine casing (not shown in FIG. 4). The structure 32 has tabs 320 that extend from the inside face of a shroud 50 that may form part of the turbine casing (not shown in FIG. 4). Each tab 320 has a folded-over portion 3200 that is to co-operate with tabs 313 of the ring sectors 310. The ring sectors 310 are arranged in annular manner beneath the shroud 50, with the folded-over portions 3130 of the tabs 313 being engaged with the folded-over portions 3200 of the tabs 320.

In order to provide good sealing between the flow passage for the gas stream through the turbine and the outside of the turbine ring, gaskets 330 are placed between adjacent ring sectors at their facing edges. More precisely, the gaskets 330 are dimensioned and placed in such a manner as to cover the circumferential ends 3111 and 3110 of two adjacent ring sectors 310. By way of example, the gaskets 330 are made of a thermally insulating material, such as a felt of oxide (alumina) fibers, or each of them made be made of an elastically deformable insulating material such as a fiber structure or an insulating foam, that is held inside a braid made with fibers that withstand high temperatures, such as ceramic fibers.

The ring sectors 310 and the gaskets 330 are held by a pressing device 340 constituted by a shoe 341 in contact with the top surface of the gasket 330, a rod 343 extending vertically from the outside surface of the shoe, and a spring 342 exerting a pressing force on the free end 3430 of the rod 343. Orifices 51 are formed through the shroud 50 to allow the rod 343 to pass.

The spring 342 is a compression spring mounted in the prestressed state between the free end 3430 of the rod 343 and an annular tab 52 extending from the outside surface 50*a* of the shroud 50. The tab 52 defines a housing between the inside surface 52*b* of said tab and the outside surface 50*a*, the height H2 of the housing being defined as a function of the height H1 of the rods 343 so that H1<H2, thereby enabling the springs 342 to be mounted in a prestressed state.

Thus, the spring 342 exerts a force on the rod 343 that is directed radially towards the inside of the ring 31 in a direction DI shown in FIG. 4 and that is transmitted to the shoe 341 via the rod 343. The shoe 341 then exerts a pressing force $F_A$ that is directed radially towards the inside of the ring 31 against the gasket 330 and against the circumferential ends 3110 and 3111 of two adjacent sectors 310 via said gaskets 330. Sealing between adjacent sectors, i.e. sealing between the gas flow passage on the inside of the ring sectors and on the outside of the ring sectors, is thus provided by the gaskets 330. In addition, since both the gaskets 330 and the ring sectors 310 are held in position by corresponding resilient means (springs 342), mechanical connection and sealing between the ring sectors is ensured even in the event of movements imposed by differential thermal expansion.

Since each spring 342 is placed beside the outside face of the ring support structure (outside face 50*a* of the shroud 50), it is spaced apart from the hot stream flowing in the passage and it is exposed only to temperatures that are compatible with the material of the spring. There is thus no need to cool the springs and materials such as metal materials can be used for fabricating them.

Each above-described ring sector is made of CMC by forming a fiber preform of shape close to the shape of the ring sector and by densifying the ring sector with a ceramic matrix.

In order to make the fiber preform, it is possible to use yarns made of ceramic fibers, e.g. SiC fiber yarns such as those sold by the Japanese supplier Nippon Carbon under the name "Nicalon", or carbon fiber yarns.

The fiber preform is advantageously made by three-dimensional weaving, or by multilayer weaving with zones of non-interlinking being provided to make it possible to space preform portions corresponding to the tabs 113 and 114 apart from the sectors 110 or corresponding to tabs 313 apart from the sectors 310.

The weaving may be of the interlock type, as shown. Other three-dimensional or multilayer weaves can be used, such as for example multi-plain or multi-satin weaves. Reference may be made to Document WO 2006/136755.

After weaving, the blank may be shaped in order to obtain a ring sector preform that is consolidated and densified with a ceramic matrix, it being possible for densification to be performed in particular by chemical vapor infiltration (CVI) as is well known.

A detailed example of fabricating CMC ring sectors is described in particular in Document US 2012/0027572.

The invention claimed is:

1. A turbine ring assembly comprising a ring support structure and a plurality of ring sectors made of ceramic matrix composite material making up a turbine ring, each of the plurality of ring sectors comprising an annular base with, in a radial direction of the turbine ring, an inside face defining the inside face of the turbine ring and an outside face facing the inside face of the ring support structure, each said annular base including at each circumferential end a circumferential edge that is held facing a circumferential edge of the circumferential end of the annular base of an adjacent one of the plurality of ring sectors in the turbine ring, wherein the assembly comprises resilient holder devices, each of the resilient holder devices exerting a force on the circumferential ends of two adjacent ring sectors of the plurality of ring sectors, holding said two adjacent ring sectors of the plurality of ring sectors in position, and wherein each of the resilient holder devices comprises a spring element present beside the outside face of the ring support structure, wherein the turbine ring assembly comprises a plurality of gaskets, each of the plurality of gaskets extending axially over the circumferential ends of two adjacent ring sectors of the plurality of ring sectors at the facing edges of said ends, the resilient holder devices exerting force that holds each of the plurality of gaskets in contact with the circumferential ends of two adjacent ring sectors of the plurality of ring sectors, wherein the inside face of each of the plurality of ring sectors is coated with an abradable material layer.

2. The turbine ring assembly of claim 1, wherein:

the ring support structure comprises an upstream annular radial flange and a downstream annular radial flange between which the plurality of ring sectors are held without being attached to said upstream annular radial and downstream annular radial flanges, each of the plurality of gaskets having an upstream end passing through a slot formed in the upstream radial flange and a downstream end passing through a slot formed in the downstream radial flange;

each of the plurality of ring sectors presents a K-shape in a plane defined by the radial direction and the circumferential direction of the turbine ring, with tabs extending from the outside face of the annular base over the circumferential ends of said annular base, circumferential edges of the tabs and the circumferential edges of the circumferential ends of each of the plurality of ring sectors being held respectively facing the circumferential edges of tabs and the circumferential edges of the plurality of ring sectors that are adjacent in the turbine ring;

each of the resilient holder devices exerts a force on the facing tabs of two adjacent ring sectors of the plurality of ring sectors that is directed radially towards the outside of the turbine ring, holding the corresponding gasket in contact with the circumferential ends of two adjacent ring sectors of the plurality of ring sectors.

3. The turbine ring assembly of claim 2, wherein the gaskets are constituted by strips of ceramic matrix composite material.

4. The turbine ring assembly of claim 2, wherein each of the resilient holder devices comprises a bolt and a spring, the bolt having a head present between the outside face of a gasket and the tabs of two adjacent ring sectors of the plurality of ring sectors, the spring being mounted in a prestressed state between a shroud of the ring support structure and a nut fastened to the end of the bolt remote from its end having the head.

5. The turbine ring assembly of claim 1, wherein:

the ring support structure includes tabs that extend from the inside face of a shroud, each tab including a folded-over portion;

each ring sector includes tabs extending from the outside face of its annular base, each tab having a folded-over portion engaged with the folded-over portion of a tab of the ring structure; and each of the resilient holder devices exerts a pressing force on each gasket of the plurality of gaskets holding the gasket in contact with the circumferential ends of two adjacent ring sectors.

6. The turbine ring assembly of claim 5, wherein each of the resilient holder devices comprises a shoe in contact with the top surface of the gasket, a rod extending vertically from the outside surface of the shoe, and a spring exerting a pressing force on the free end of the rod.

* * * * *